US006165020A

United States Patent [19]

Cheng et al.

[11] Patent Number: 6,165,020

[45] Date of Patent: Dec. 26, 2000

[54] CONNECTOR HAVING SAFETY FUNCTION FOR CAR BATTERY

[76] Inventors: Wen Tzung Cheng; Wen Ho Cheng, both of No. 78 Chao Chou St., Tao Yuan, Taiwan

[21] Appl. No.: 09/501,990

[22] Filed: Feb. 11, 2000

[51] Int. Cl.[7] ..... H01R 13/68

[52] U.S. Cl. ..... 439/621; 439/957

[58] Field of Search ..... 439/621, 805, 439/957, 763, 764, 761, 754, 755, 756

[56] References Cited

U.S. PATENT DOCUMENTS

| | | | |
|---|---|---|---|
| 5,171,169 | 12/1992 | Butcher et al. | 439/755 |
| 5,951,328 | 9/1999 | Roper, Jr. | 439/621 |
| 6,071,155 | 6/2000 | Laing | 439/805 |

*Primary Examiner*—Brian Sircus
*Assistant Examiner*—Phuong K T Dinh
*Attorney, Agent, or Firm*—Rosenberg, Klein & Lee

[57] ABSTRACT

The present invention proposes a connector having safety function for a car battery. The connector comprises a main body, at least an adapting socket, and a safety fuse. The main body is a conductor having a gripping part such that it can be fixedly gripped on an electrode of a battery. A T-shaped or a dovetailed locking groove is disposed on the main body. The adapting socket has an insulation block and a first conductive block and a second conductive block installed in the insulation block. These two conductive blocks are mutually isolated. The first conductive block has a T-shaped or a dovetailed locking plate which can be connected to and assembled with the locking groove. At least an exposed wiring hole for assembly of a core line of an electric wire is disposed on the second conductive block. The two conductive blocks has corresponding insertion holes or insertion plates for the insertion of a general insertion-type safety fuse. The electric wire can be connected indirectly to the battery successively via the second conductive block, the safety fuse, the first conductive block, and the main body of the connector. The safety fuses can not only protect electronic apparatuses from large current, but also can be concentrated on the main body of the connector to facilitate check, assembly, and replacement.

9 Claims, 7 Drawing Sheets

CONNECTOR HAVING SAFETY FUNCTION FOR CAR BATTERY

FIELD OF THE INVENTION

The present invention relates to a connector for a car battery and, more particularly, to a connector having safety function for a car battery, which is installed on an electrode of a car battery such that electric wires can be orderly and separately connected thereon, and safety devices that can be assembled and disassembled easily are further attached to facilitate safety and convenience.

BACKGROUND OF THE INVENTION

Many electronic apparatuses, such as motors, lights, audio systems, or air conditioners, are installed on a general car, which has only a very limited number of batteries for supplying electric power. Therefore, how to integrate and distribute electric wires of various electronic apparatuses is very important. Especially, for a new car having advanced electronic instruments such as the anti-braking system (ABS), the global positioning system (GPS), or other high-level audio-visual systems, there will be much more electric wires to be allocated. These electric wires are gripped on the same electrodes of a battery via gripping rings on the ends thereof in prior art. Therefore, it will be very inconvenient for assembly and disassembly of each electric wire on the electrode. Also, because these electric wires adjoin and overlap with one another, the safety problem should be very carefully take care of. As a result, many specific connectors for a battery have been developed to solve the above mentioned problems.

These connectors are mainly integrally formed copper conductors. A C-shaped gripper controlled by a fastening bolt is installed in most of these connectors to grip on an electrode of a battery. The position other than the C-shaped gripper of the connector can be expanded to form a block of arbitrary shape. A plurality of spaced wiring holes are disposed at proper positions thereon. A fastening bolt is installed perpendicularly to a corresponding wiring hole such that the core line of each electric wire can be inserted in the wiring hole and fixedly assembled by screwing the fastening bolt. Each electric wire can thus be separately and indirectly connected to the same electrode.

To make sure that better safety can be obtained, a safety device (such as a safety fuse) can be further joined with each electric wire. When loading current is too large due to some specific factor, electric power will be automatically cut off through the breaking or the switching off of the safety device. However, the locations of general safety devices vary. Some are disposed at the middle sections of the electric wires such that they may be mixed with complex components of the car or near high-temperature equipment or electric systems. It is thus very difficult to check or replace them.

SUMMARY AND OBJECTS OF THE PRESENT INVENTION

The primary object of the present invention is to provide a connector having safety function for a car battery such that electric wires can be assembled and electrically connected thereon, insertion-type safety devices for protecting electronic apparatuses can be easily concentrated and inserted therein, and safety devices can further be checked and replaced conveniently.

According to the present invention, at least an adapting socket is movably installed on the main body of a car battery.

The adapting socket is primarily an insulation block having two isolated conductive blocks installed therein. One of these two conductive blocks is assembled and electrically connected to the main body of the connector. Electric wires can be assembled and connected in the other conductive block. Corresponding insertion holes or plates are installed on these two conductive blocks such that general insertion-type safety fuses can be inserted therein.

The various objects and advantages of the present invention will be more readily understood from the following detailed description when read in conjunction with the appended drawings, in which:

DETAILED DESCRIPTION OF PREFERRED EMBODIMENT

Figure 1:
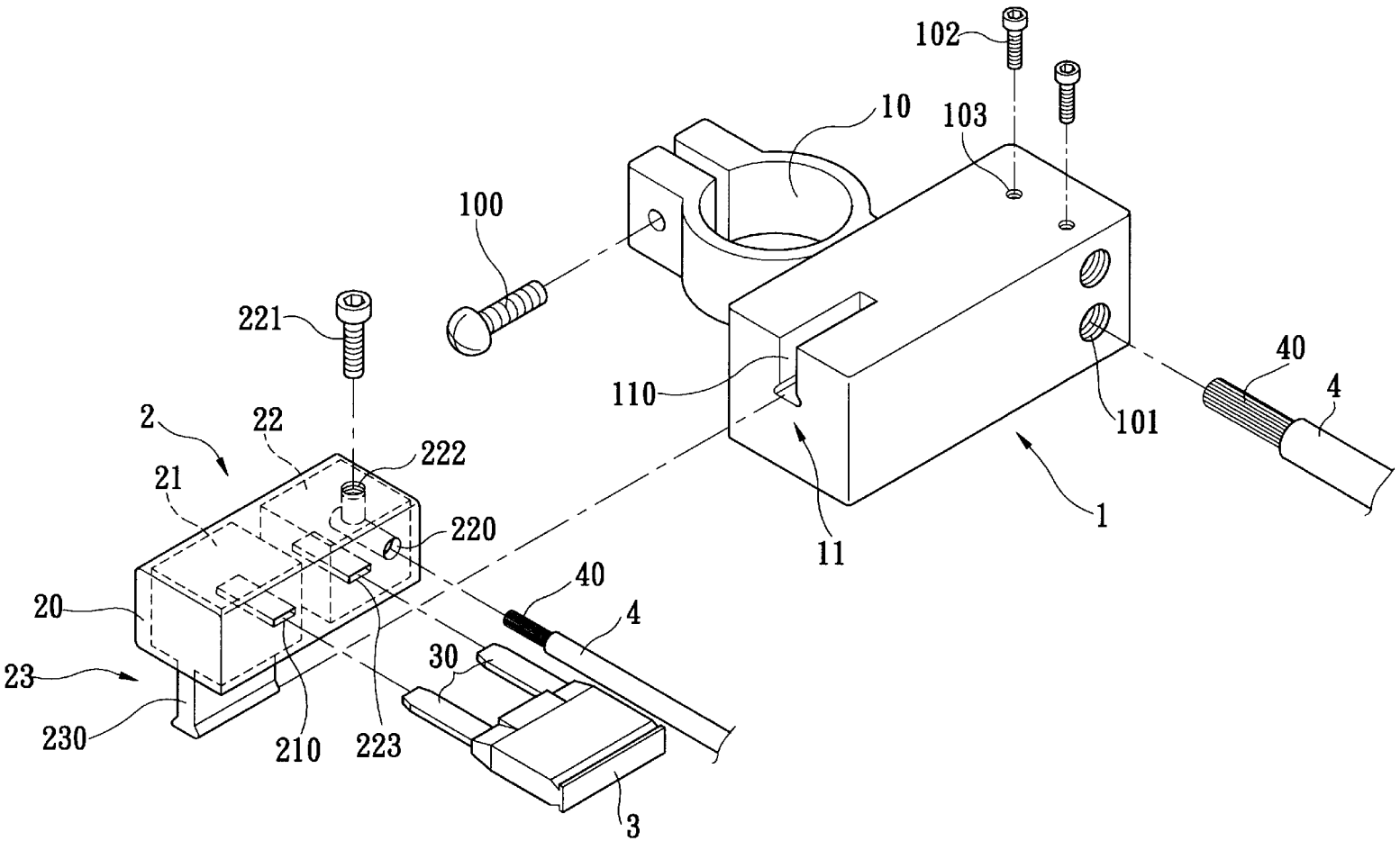
FIG. 1 is an exploded perspective view according to an embodiment of the present invention when a first male safety fuse is used.

FIG. 1 shows a connector having safety function for a car battery according to a preferred embodiment of the present invention, which comprises a main body 1, at least an adapting socket 2, and a safety fuse 3.

The main body 1 is a copper conductor having a C-shaped gripping part 10 matched with a bolt 100. The C-shaped gripper can be fixedly gripped on an electrode of a battery via the bolt 100. Wiring holes 101 for insertion of core lines 40 of electric wires 4 are disposed on the main body 1. Screw holes 103 perpendicular to and penetrating to corresponding wiring holes 101 for screwing of fastening bolt 102 are also disposed on the main body 1. Particularly, at least a bearing part 11 is installed on the main body 1. The bearing part 11 can be a T shaped or a dovetailed locking groove 110.

The adapting socket 2 has an insulation block 20 and a first conductive block 21 and a second conductive block 22 installed in the insulation block 20. These two conductive blocks 21 and 22 are mutually isolated. The first conductive block 21 has a connecting part 23 protruding out from the insulation block 20 and corresponding to the bearing part 11. The connecting part 23 can have a T-shaped or a dovetailed locking plate 230 to match the bearing part 11 such that the adapting socket 2 can be electrically connected to and assembled on the main body 1 through the sliding of the locking plate 230 into the locking groove 110. At least a wiring hole 220 is disposed on the second conductive block 22. At least a screw hole 222 perpendicular to the wiring hole 220 for the screwing of a fastening bolt is also disposed on the second conductive block 22. Thereby the core line 40 of the electric wire 4 can be electrically assembled and fixed in the wiring hole 220.

Figure 4:
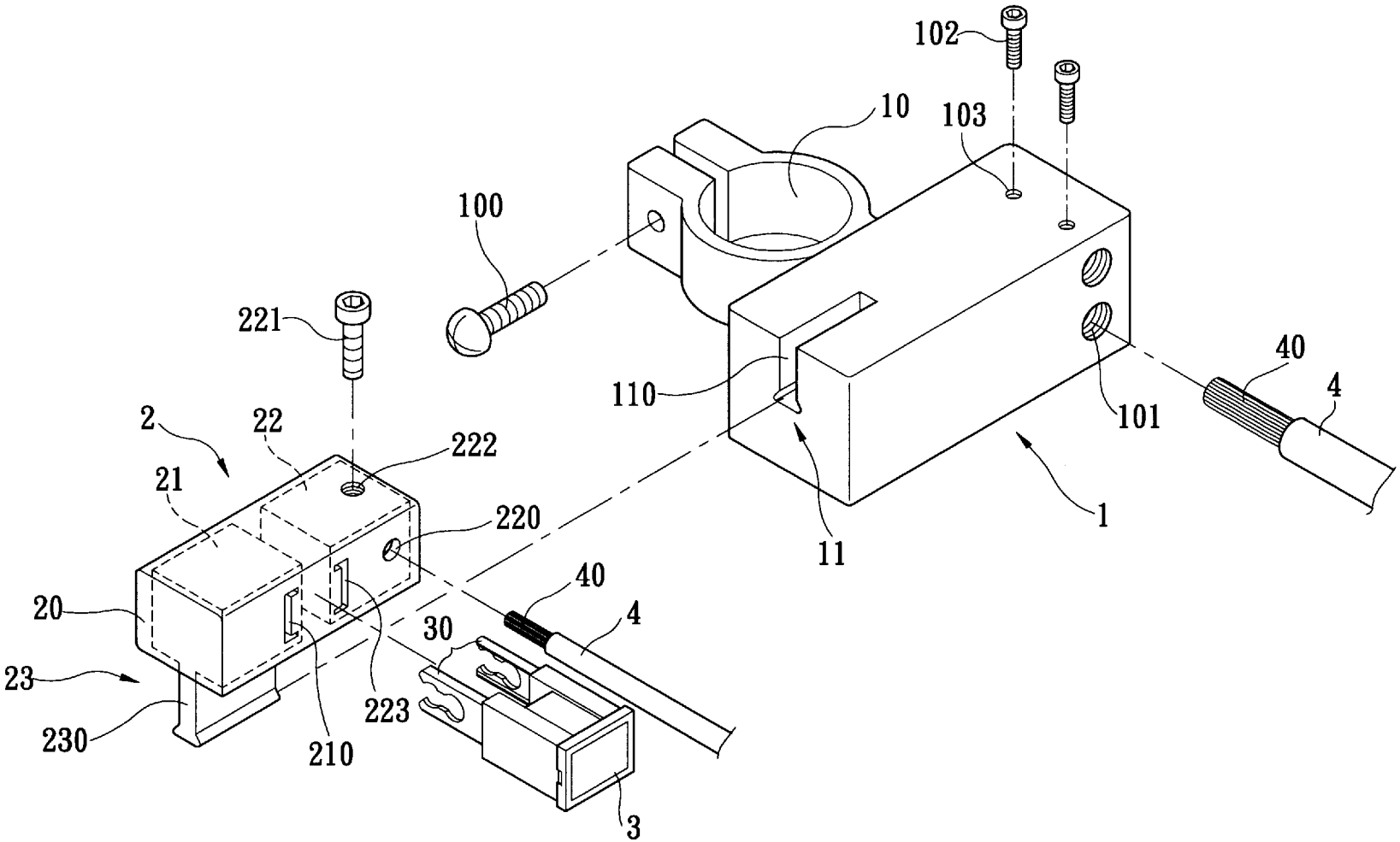
FIG. 4 is an exploded perspective view according to another embodiment of the present invention when a second male safety fuse is used.
Figure 5:
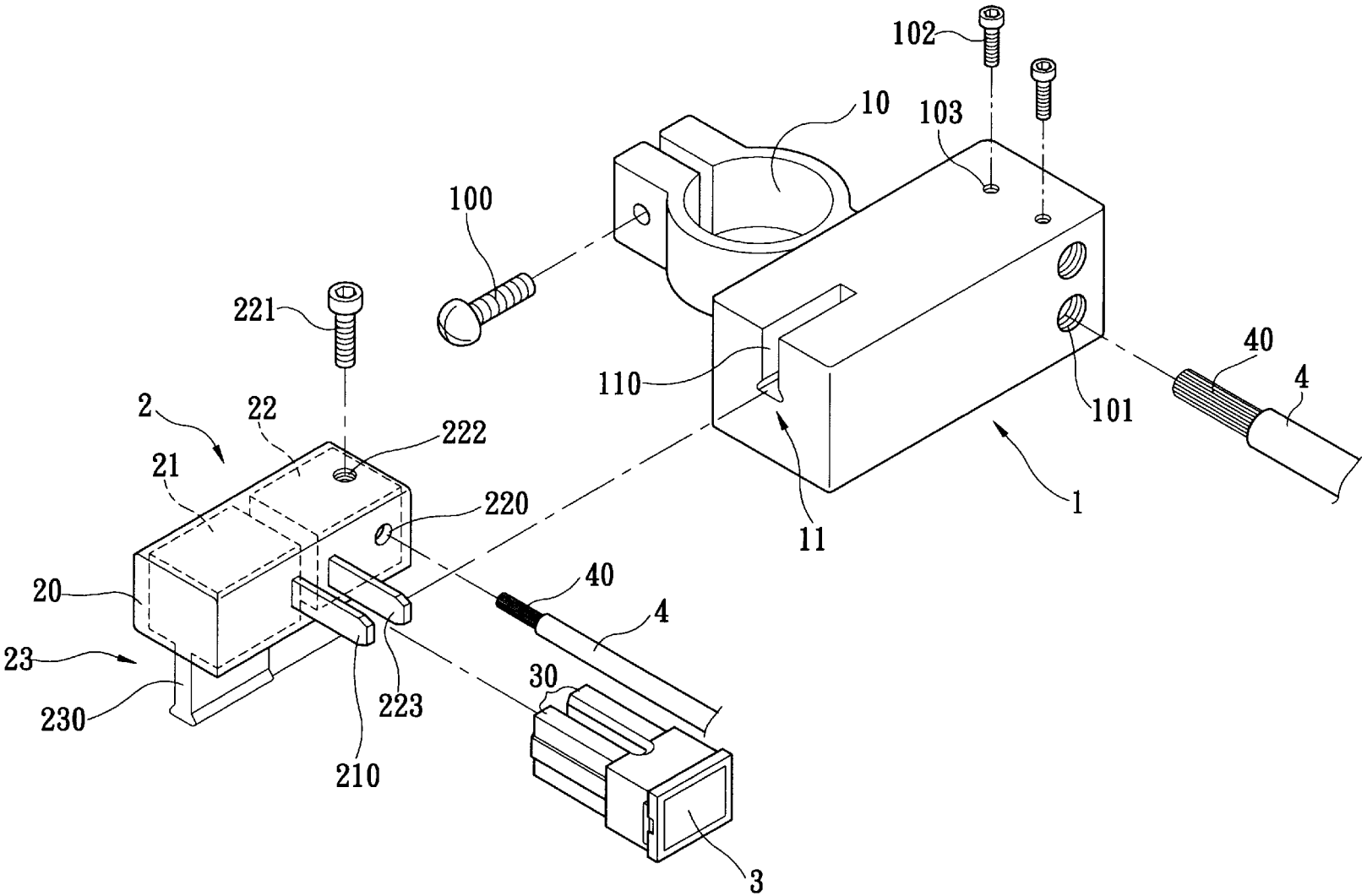
FIG. 5 is an exploded perspective view according to yet another embodiment of the present invention when a second female safety fuse is used.

At this time, the first conductive block 21 and the second conductive block 22 are mutually isolated. Even when the main bodies 1 are gripped on the electrodes, the electric wire 4 and the battery are open-circuited. Corresponding electrode parts 210 and 223 must be respectively installed on the first conductive block 21 and the second conductive block 22 such that electrode parts 30 of the insertion-type safety fuse 3 can be inserted in the electrode parts 210 and 223 to achieve electric connection. The type of the electrode parts 210 and 223 of the two conductive blocks 21 and 22 are opposite to that of the electrode parts 30 of the safety fuse 3. When a first male (shown in FIG. 1) or a second male (shown in FIG. 4) safety fuse 3 having electrode parts 30 being insertion plates is adopted, the electrode parts 210 and 223 of the two conductive blocks 21 and 22 must be female insertion holes. Contrarily, when a second female (shown in FIG. 5) safety fuse 3 having electrode parts 30 being insertion holes is adopted, the electrode parts 210 and 223 of the two conductive blocks 21 and 22 must be male insertion plates.

Figure 2:
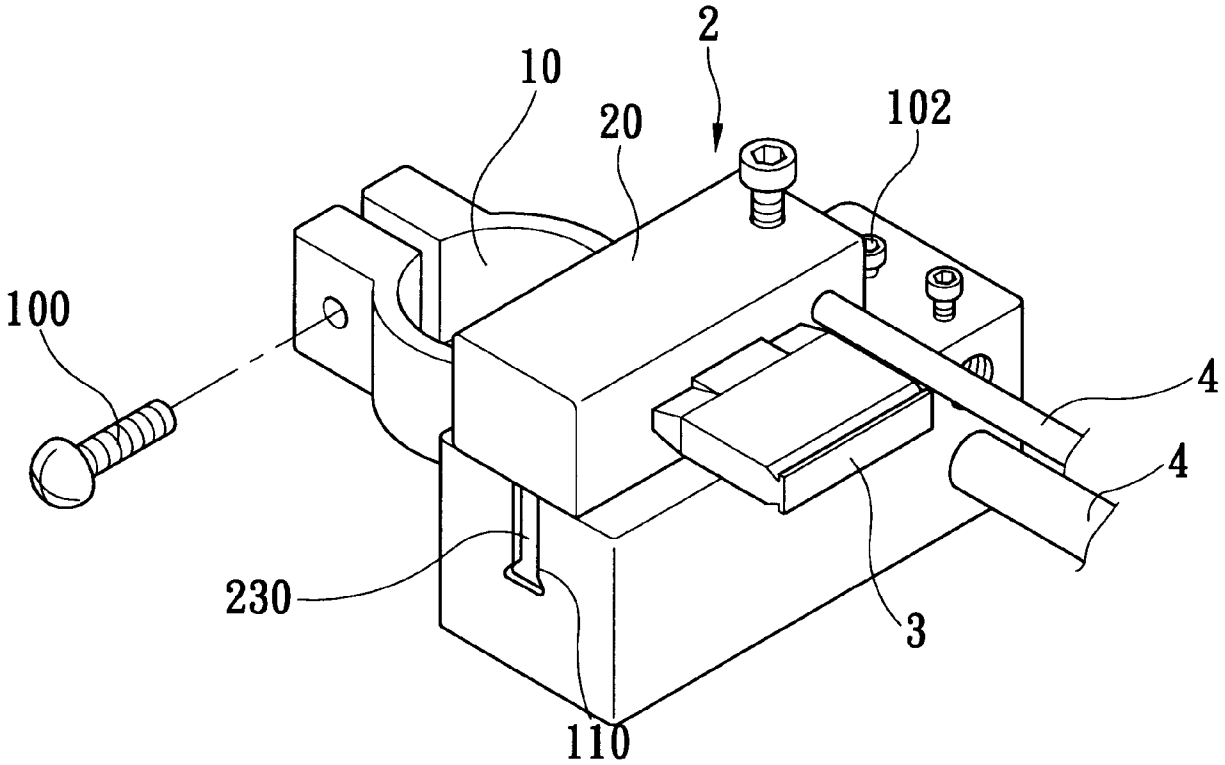
FIG. 2 is a perspective view according to the embodiment shown in FIG. 1.
Figure 3:
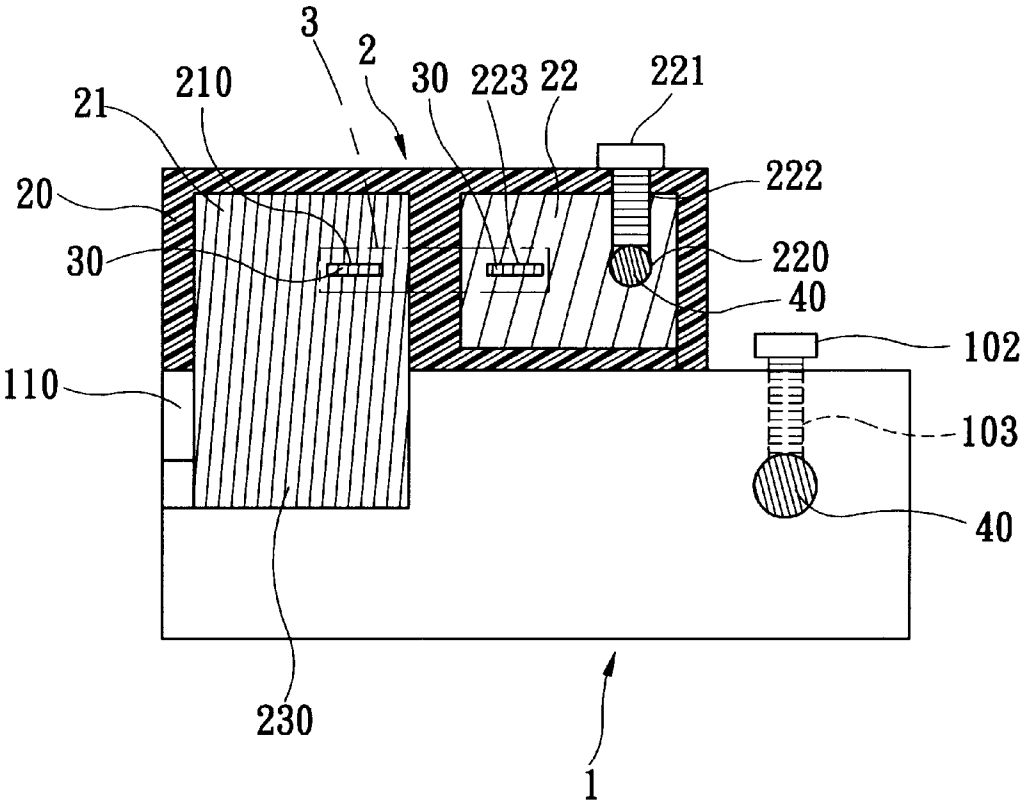
FIG. 3 is a cross-sectional perspective view according to the embodiment shown in FIG. 2.

As shown in FIGS. 2 and 3, after the safety fuse 3 is inserted in the adapting socket 2, the first conductive block 21 and the second conductive block 22 are electrically connected via the safety fuse 3. That is, the electric wire can be indirectly connected to the electrodes of a car battery successively via the second conductive block 22, the safety fuse 3, the first conductive block 21, and the main body 1. Electric power can thus be delivered to an electronic apparatus via the electric wire 4. In other words, through the installation of the adapting socket to match the main body of the connector, electric wires 4 can be orderly and separately assembled and connected indirectly to the car battery. Moreover, general safety fuses 3 for limiting current to protect electronic apparatuses can be easily inserted and replaced. Also, the safety fuses 3 can be concentrated on the main bodies 1 that are gripped on the electrodes of the car battery such that the safety fuses 3 can be checked and replaced conveniently.

Figure 6:
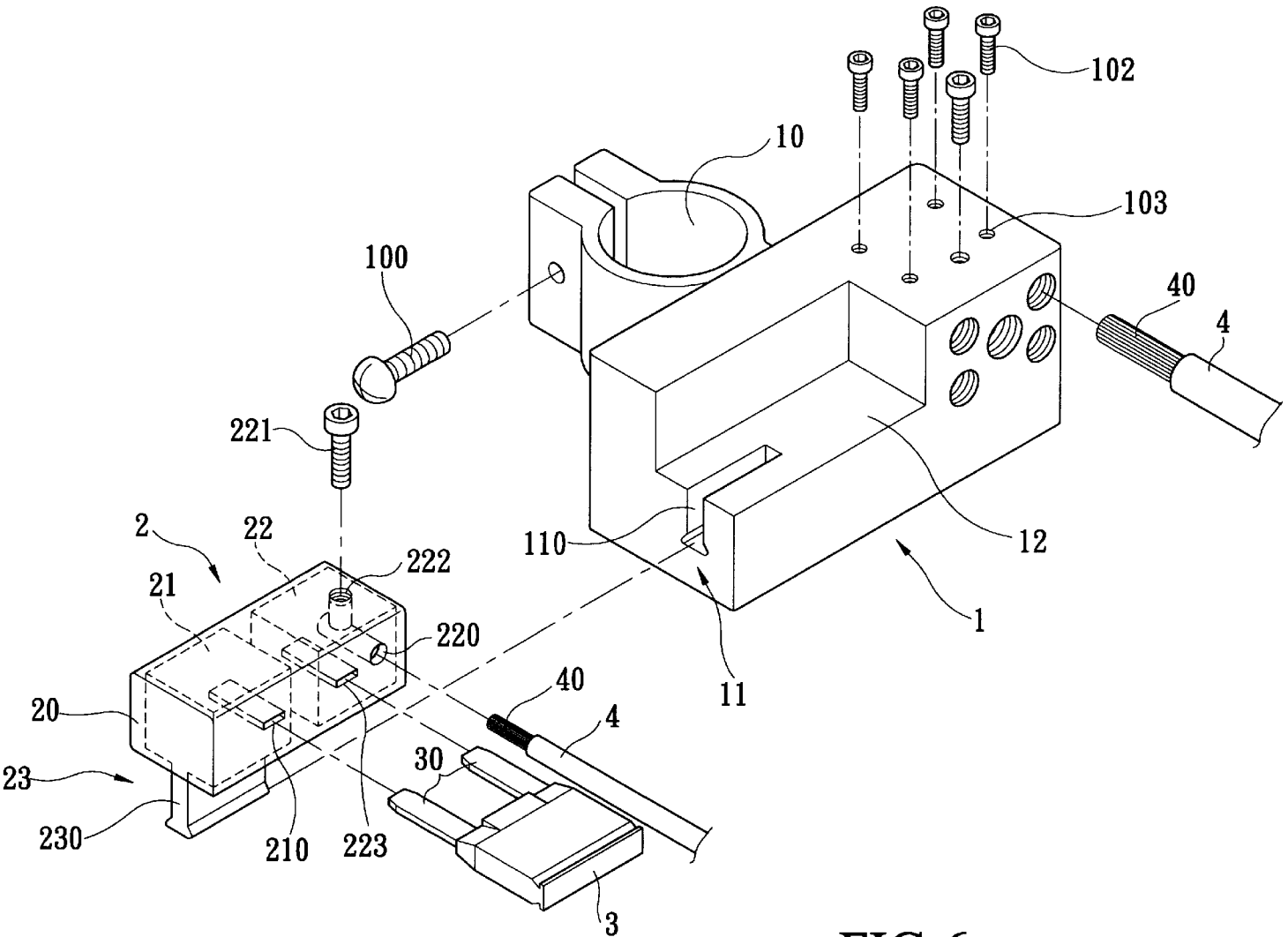
FIG. 6 is an exploded perspective view according to still yet another embodiment of the present invention when a different shaped main body of the connector is adopted.
Figure 7:
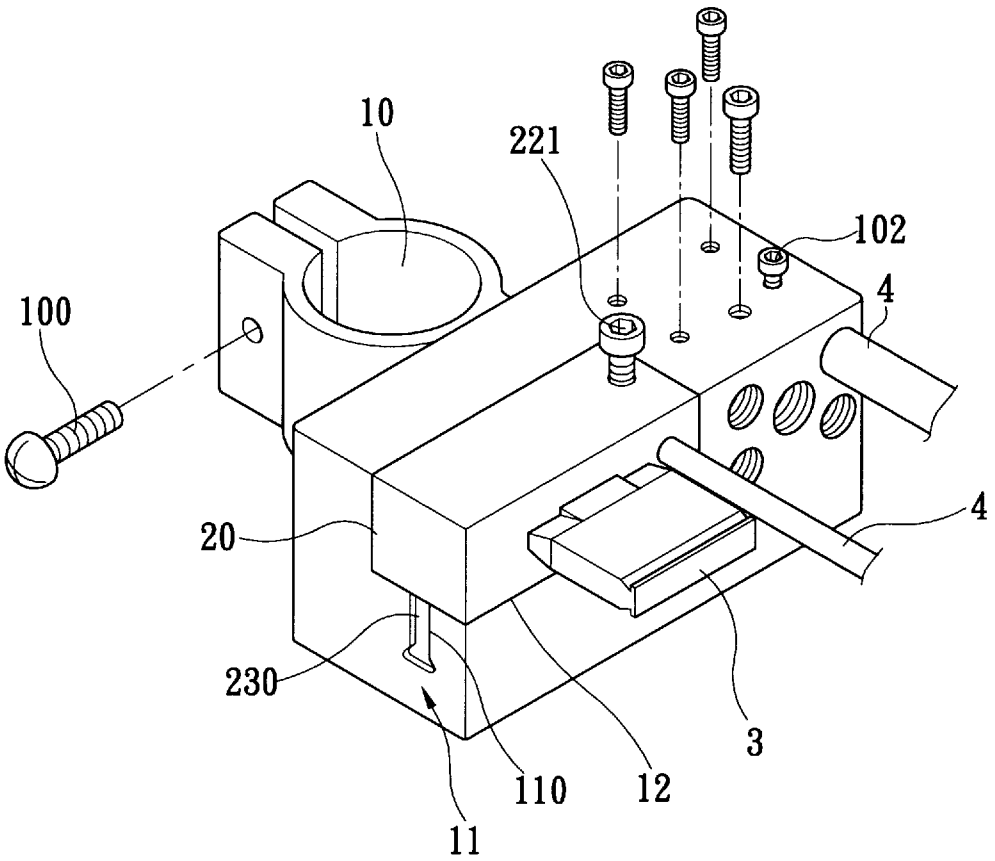
FIG. 7 is a perspective view according to the embodiment shown in FIG. 6.

Additionally, as shown in FIG. 6, the volume of the main body 1 of the connector can be properly enlarged to form a groove 12 thereon such that the adapting socket 2 can be exactly accommodated in the groove. As shown in FIG. 7, the adapting socket 2 can be exactly and fixedly locked in the groove 2 to maintain the delicacy and regularity of the connector. Thereby more wiring holes 101 and adapting sockets 12 can be installed thereon for assembly of more electric wires 4.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A connector having safety function for a car battery comprising:

a main body being a conductor and having a gripping part such that it can be gripped on an electrode of a battery, said main body having at least a bearing part, an adapting socket having an insulation block and a first and a second conductive blocks installed in said insulation block, said two conductive blocks being mutually isolated, said first conductive block having a connecting part protruding out from said insulation block and electrically connected to and assembled with said bearing part of said main body, at least an exposed wiring hole being disposed on said second conductive block for insertion of a core line of an electric wire, exposed electrode parts being installed at corresponding positions of said two conductive blocks, a safety fuse having a pair of electrode parts to be connected to and assembled with said electrode parts of said adapting socket such that said two conductive blocks can achieve electric connection.

2. The connector having safety function for a car battery of claim 1, wherein said bearing part of said main body can be a locking groove, and said connecting part of said adapting socket is a corresponding locking plate.

3. The connector having safety function for a car battery of claim 2, wherein said locking groove and said locking plate can be correspondingly T-shaped.

4. The connector having safety function for a car battery of claim 2, wherein said locking groove and said locking plate can be correspondingly dovetail-shaped.

5. The connector having safety function for a car battery of claim 1, wherein said safety fuse can be a general insertion-type safety fuse.

6. The connector having safety function for a car battery of claim 1, wherein said electrode parts of said safety fuse are male insertion plates, while said electrode parts of said adapting socket are corresponding female insertion holes.

7. The connector having safety function for a car battery of claim 1, wherein said electrode parts of said safety fuse are female insertion holes, while said electrode parts of said adapting socket are corresponding male insertion plates.

8. The connector having safety function for a car battery of claim 1, wherein said second conductive block has at least a screw hole perpendicular to and penetrating to said wiring hole, and the core line of the electric wire can be fixed in said wiring hole by the screwing of a fastening bolt in said screw hole.

9. The connector having safety function for a car battery of claim 1, wherein said main body further comprises a groove having said bearing part to accommodate said adapting socket such that said adapting socket can be exactly locked in said groove.

* * * * *